US007789673B2

(12) United States Patent
Lee et al.

(10) Patent No.: US 7,789,673 B2
(45) Date of Patent: Sep. 7, 2010

(54) SIGNAL TERMINAL AND PLUG CONNECTOR WITH SIGNAL TERMINALS

(75) Inventors: Kuo-Ching Lee, Taipei Hsien (TW); Ta-Teh Meng, Taipei Hsien (TW); Jian-Li Guan, Taipei Hsien (TW)

(73) Assignee: Advanced Connectek Inc. (TW)

( * ) Notice: Subject to any disclaimer, the term of this patent is extended or adjusted under 35 U.S.C. 154(b) by 135 days.

(21) Appl. No.: 12/290,706

(22) Filed: Nov. 3, 2008

(65) Prior Publication Data

US 2009/0221156 A1 Sep. 3, 2009

(30) Foreign Application Priority Data

Feb. 29, 2008 (TW) ..... 97203463 U

(51) Int. Cl.
*H01R 12/00* (2006.01)

(52) U.S. Cl. ..... 439/74

(58) Field of Classification Search ..... 439/66, 439/74, 842, 733.1, 346, 660
See application file for complete search history.

(56) References Cited

U.S. PATENT DOCUMENTS 5,116,247 A * 5/1992 Enomoto et al. ..... 439/660
5,393,234 A * 2/1995 Yamada et al. ..... 439/62
5,498,167 A * 3/1996 Seto et al. ..... 439/74
5,876,217 A 3/1999 Ito et al.
5,885,092 A 3/1999 Ito et al.
5,931,689 A * 8/1999 Patel ..... 439/346
6,135,785 A * 10/2000 Niitsu ..... 439/74
6,338,630 B1 * 1/2002 Dong ..... 439/74
6,884,089 B2 * 4/2005 Obikane et al. ..... 439/74
7,484,969 B2 * 2/2009 Shiu ..... 439/74
7,677,903 B1 * 3/2010 Huang et al. ..... 439/74

* cited by examiner

*Primary Examiner*—Alexander Gilman
(74) *Attorney, Agent, or Firm*—Jackson Walker, LLP

(57) ABSTRACT

A plug connector has an insulative housing and a plurality of signal terminals. The insulative housing has a plurality mounting channels and each mounting channel has an interfering portion. The signal terminals are mounted respectively in the mounting channels and each signal terminals has a first clamping portion and a second clamping portion. Each of the first and second clamping portions has at least on barb stabbing and biting the interfering portion of a corresponding mounting channel to securely hold the signal terminal in the insulative housing.

10 Claims, 8 Drawing Sheets

SIGNAL TERMINAL AND PLUG CONNECTOR WITH SIGNAL TERMINALS

BACKGROUND OF THE INVENTION

1. Field of the Invention

The present invention relates to a connector, and more particularly to a plug connector that has an insulative housing and a plurality of signal terminals securely mounted in the insulative housing.

2. Description of Related Art

Connectors are important mediums to allow different electronic devices to communicate with each other. Especially, the board connectors are applied generally to portable electronic devices such as cellular phones, digital cameras.

U.S. Pat. No. 5,876,217 discloses a conventional board connector assembly that comprises a plug connector and a corresponding receptacle connector. The plug connector has an insulative housing, a plurality of terminals and a locking portion that protrude from the insulative housing. The contacting portion and locking portion have a "nest" defined therebetween to accommodate a part of the receptacle connector. Each terminal has a contacting portion has a frictional engagement with one of the terminals of the receptacle connector. The locking portion is engaged with a recess of the receptacle connector.

Similar conventional board connector assemblies are disclosed in U.S. Pat. Nos. 5,885,092 and 5,931,689.

However, the engagement of the aforementioned conventional board connector assemblies is not firm enough under some severe conditions. For instance, when cellular phone falls off to hit the ground, the plug and receptacle connectors of the board connector assembly inside the cellular phone would be disconnected probably from each other to fail the cellular phone.

To overcome the shortcomings, the present invention provides a signal terminal and a plug connector with the signal terminal to mitigate or obviate the aforementioned problems.

SUMMARY OF THE INVENTION

The main objective of the invention is to provide a plug connector that has an insulative housing and multiple signal terminals securely mounted in the insulative housing.

A plug connector in accordance with the present invention comprises an insulative housing and a plurality of signal terminals. The insulative housing has a plurality mounting channels and each mounting channel has an interfering portion. The signal terminals are mounted respectively in the mounting channels and each signal terminals has a first clamping portion and a second clamping portion. Each of the first and second clamping portions has at least on barb stabbing and biting the interfering portion of a corresponding mounting channel to securely hold the signal terminal in the insulative housing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
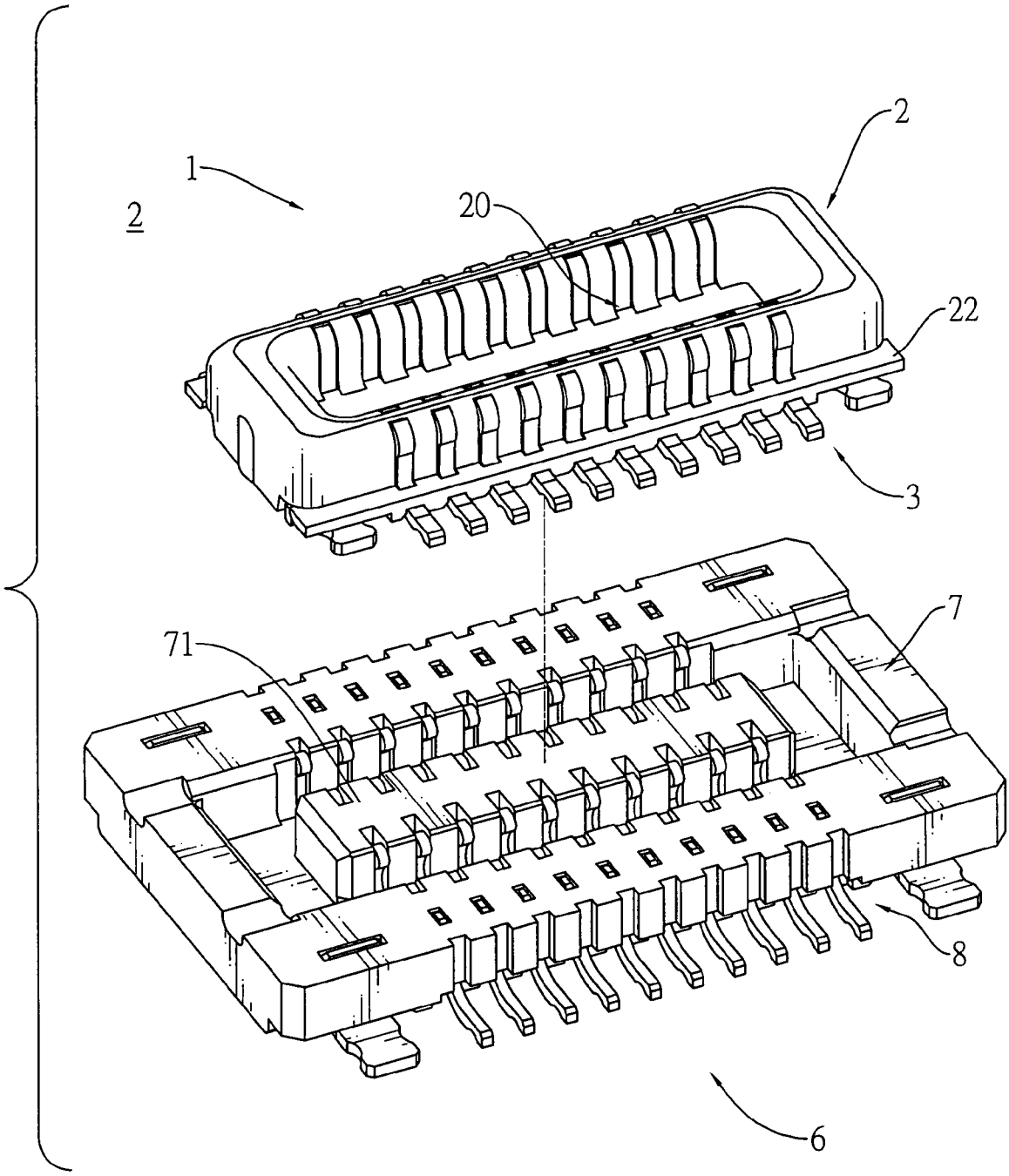
FIG. 1 is a partial exploded perspective view of a plug connector and a receptacle connector of a board connector assembly in accordance with the present invention.
Figure 2:
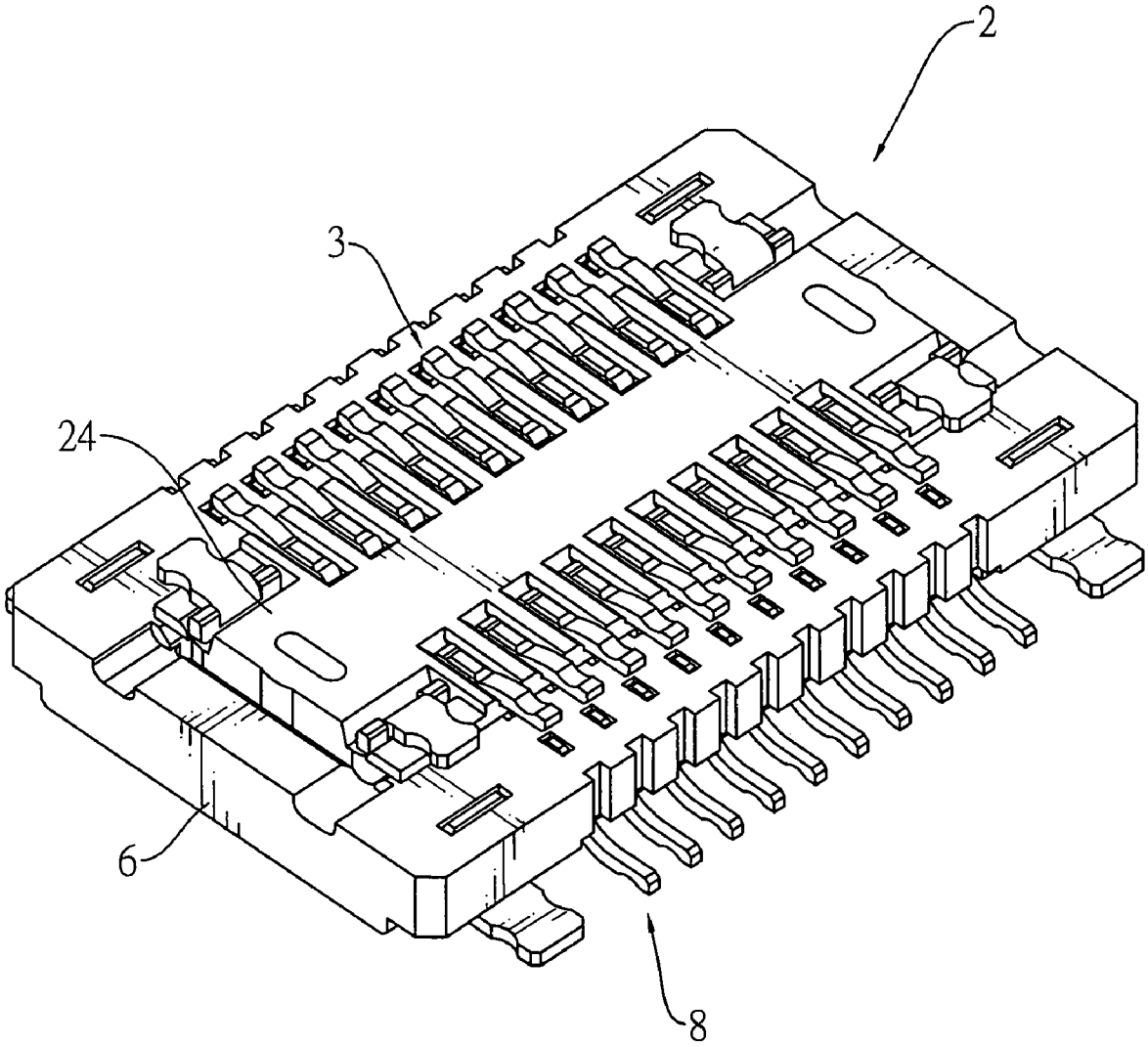
FIG. 2 is a perspective view of the plug connector engaged with the receptacle connector of the board connector assembly in FIG. 1.
Figure 3:
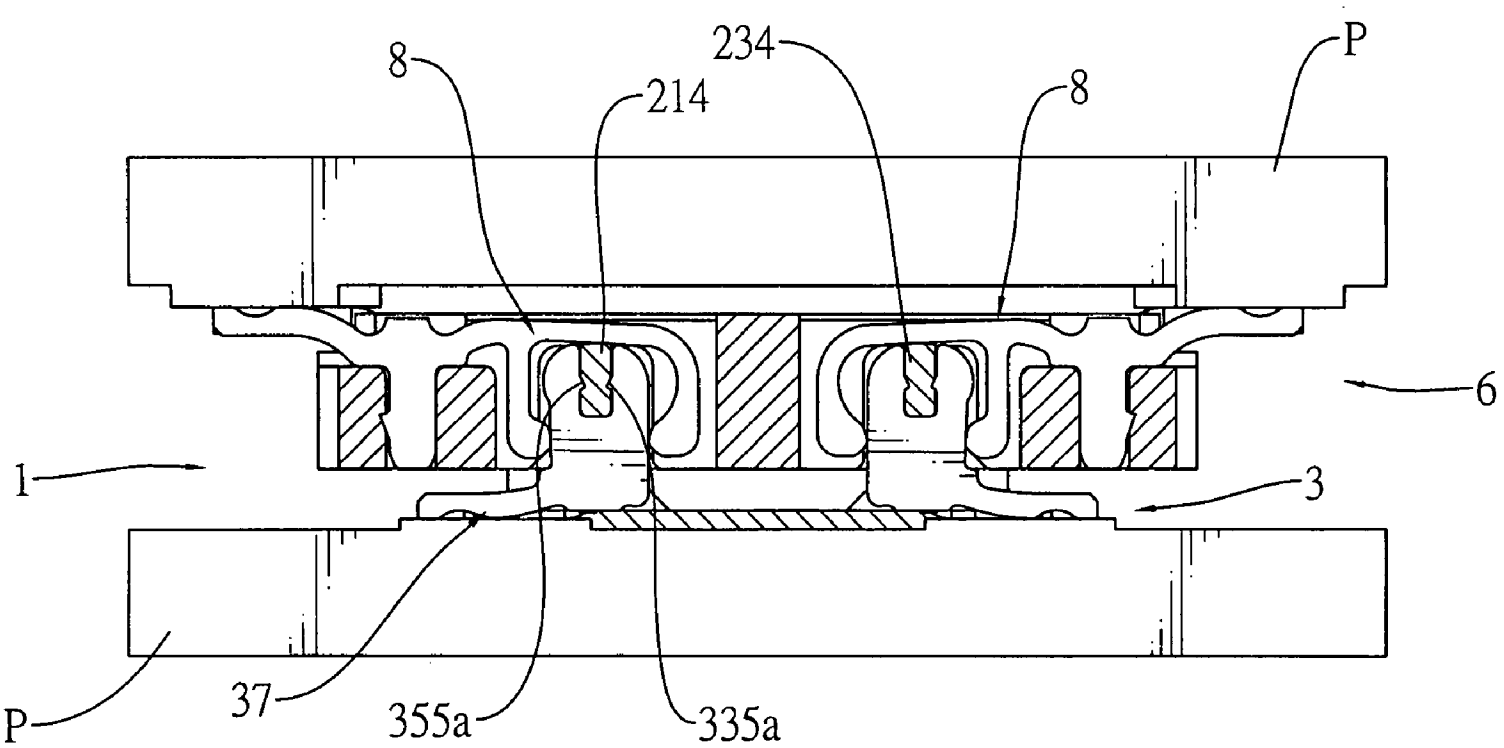
FIG. 3 is a cross sectional side end view of the board connector assembly in FIG. 2.
Figure 4:
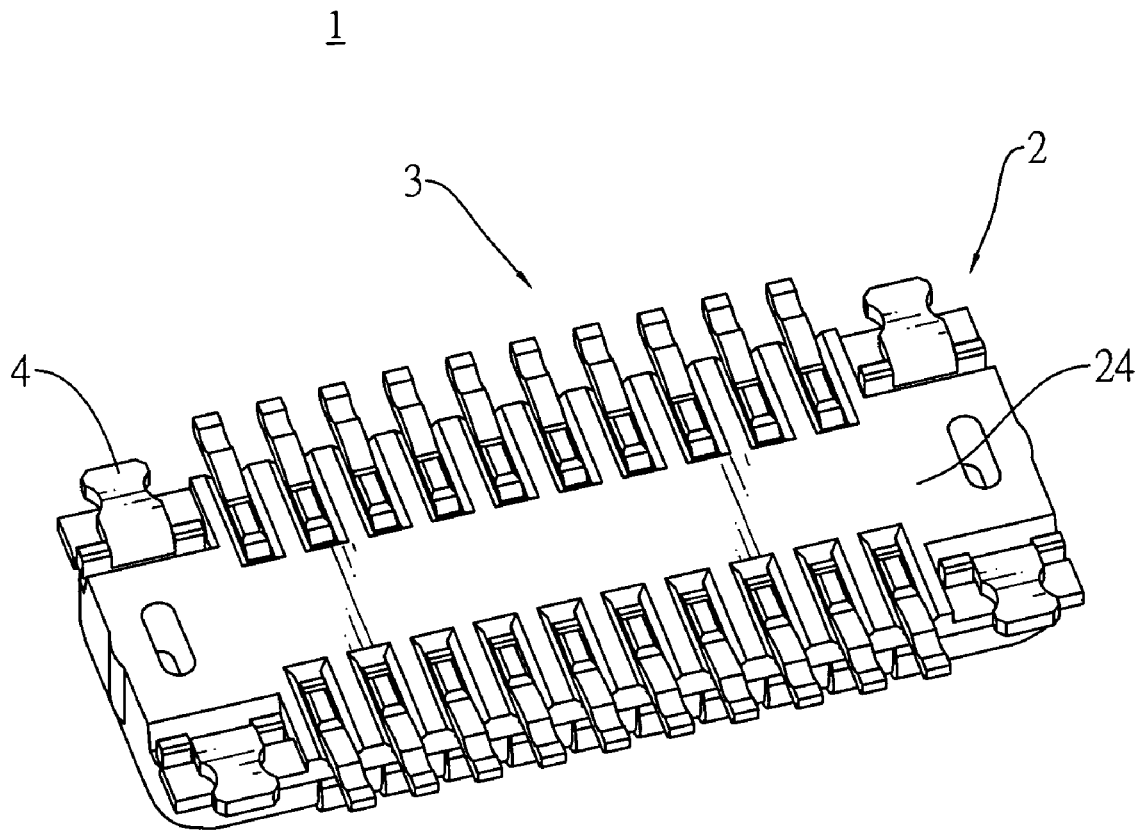
FIG. 4 is a perspective view of the plug connector in FIG. 1.

With reference to FIGS. 1 and 2, a board connector assembly in accordance with the present invention comprises a plug connector (1) and a receptacle connector (6). The plug and receptacle connectors (1, 6) correspond respectively to and are securely mounted respectively on two printed circuit boards (PCBs) (P).

Figure 5:
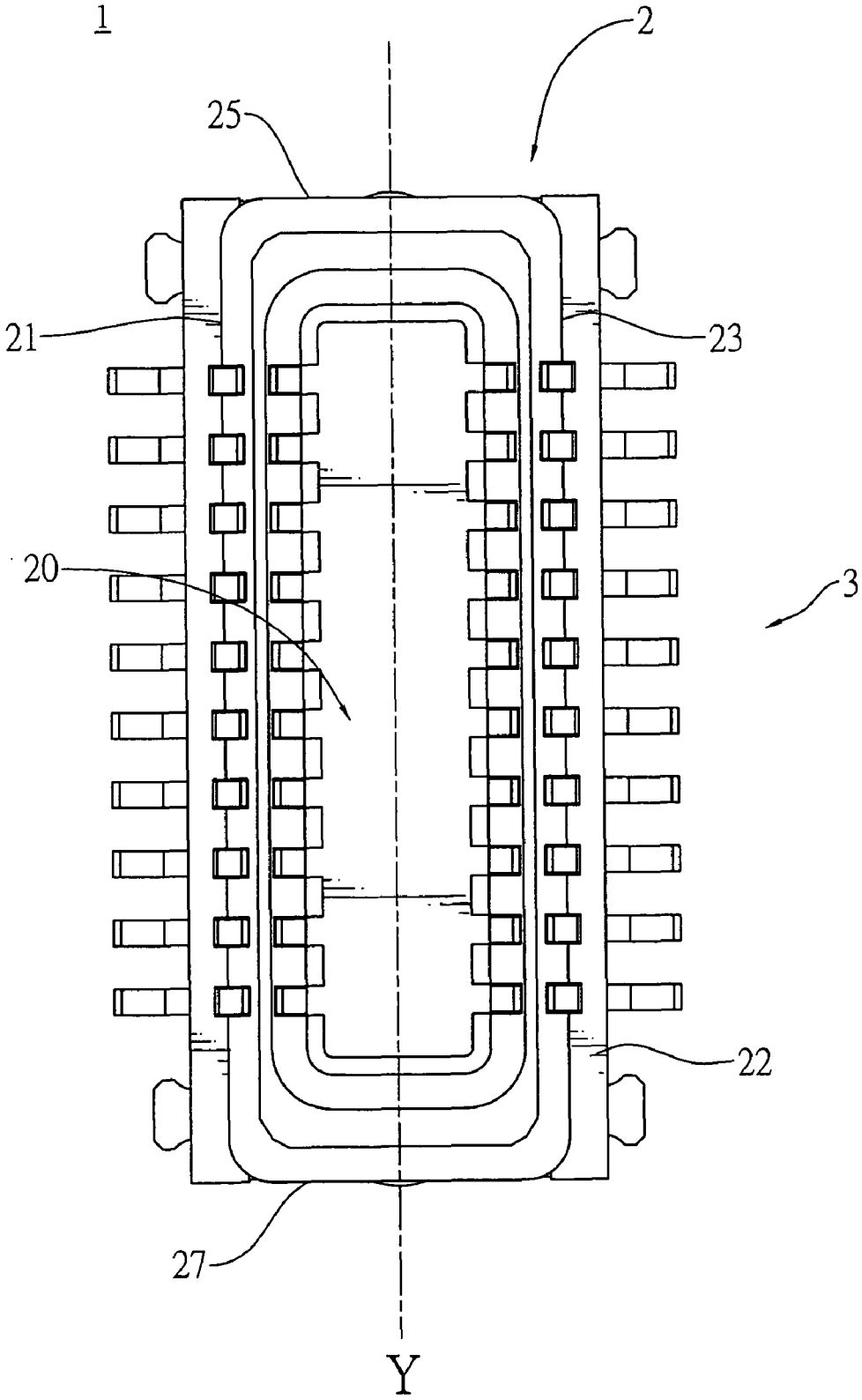
FIG. 5 is a top view of the plug connector in FIG. 4.
Figure 6:
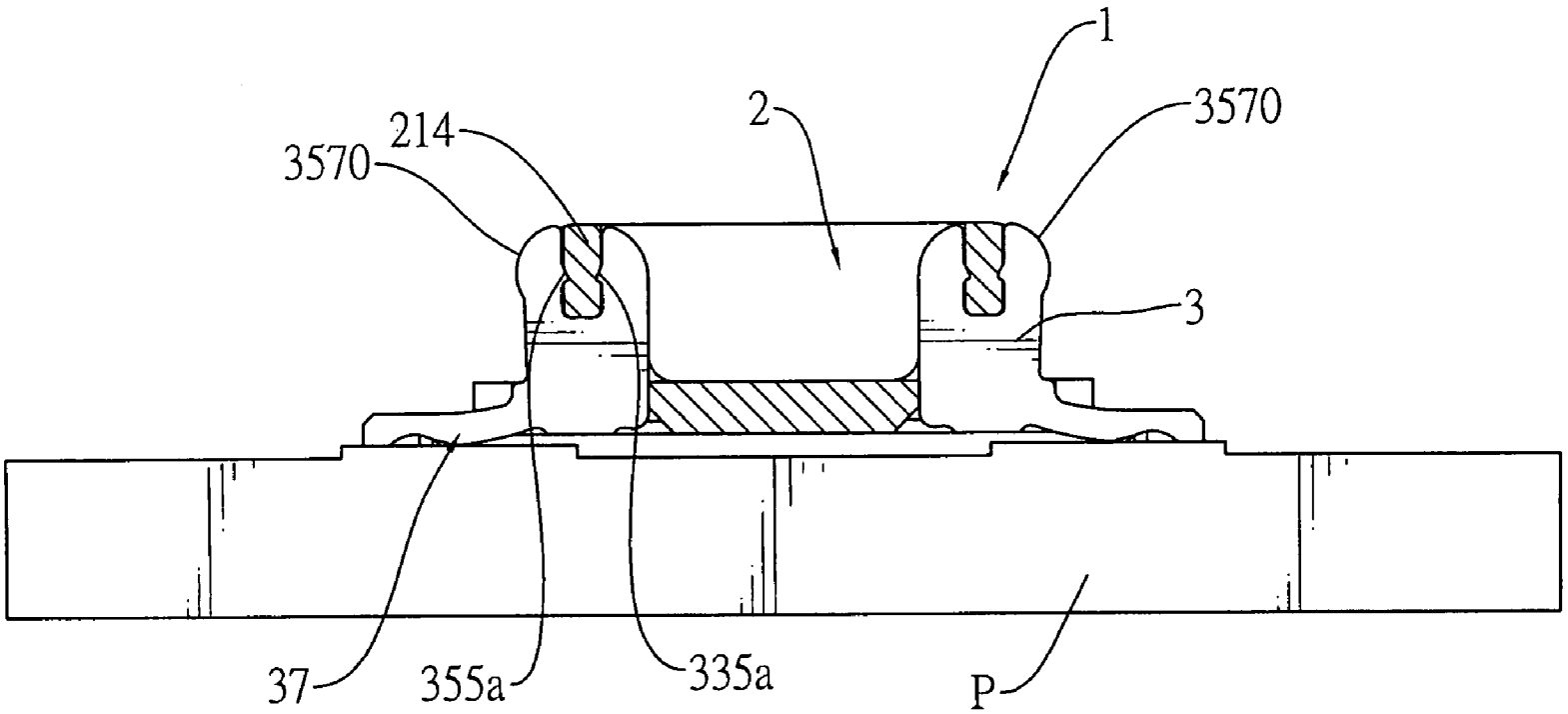
FIG. 6 is a cross sectional end view of the plug connector in FIG. 5.
Figure 7:
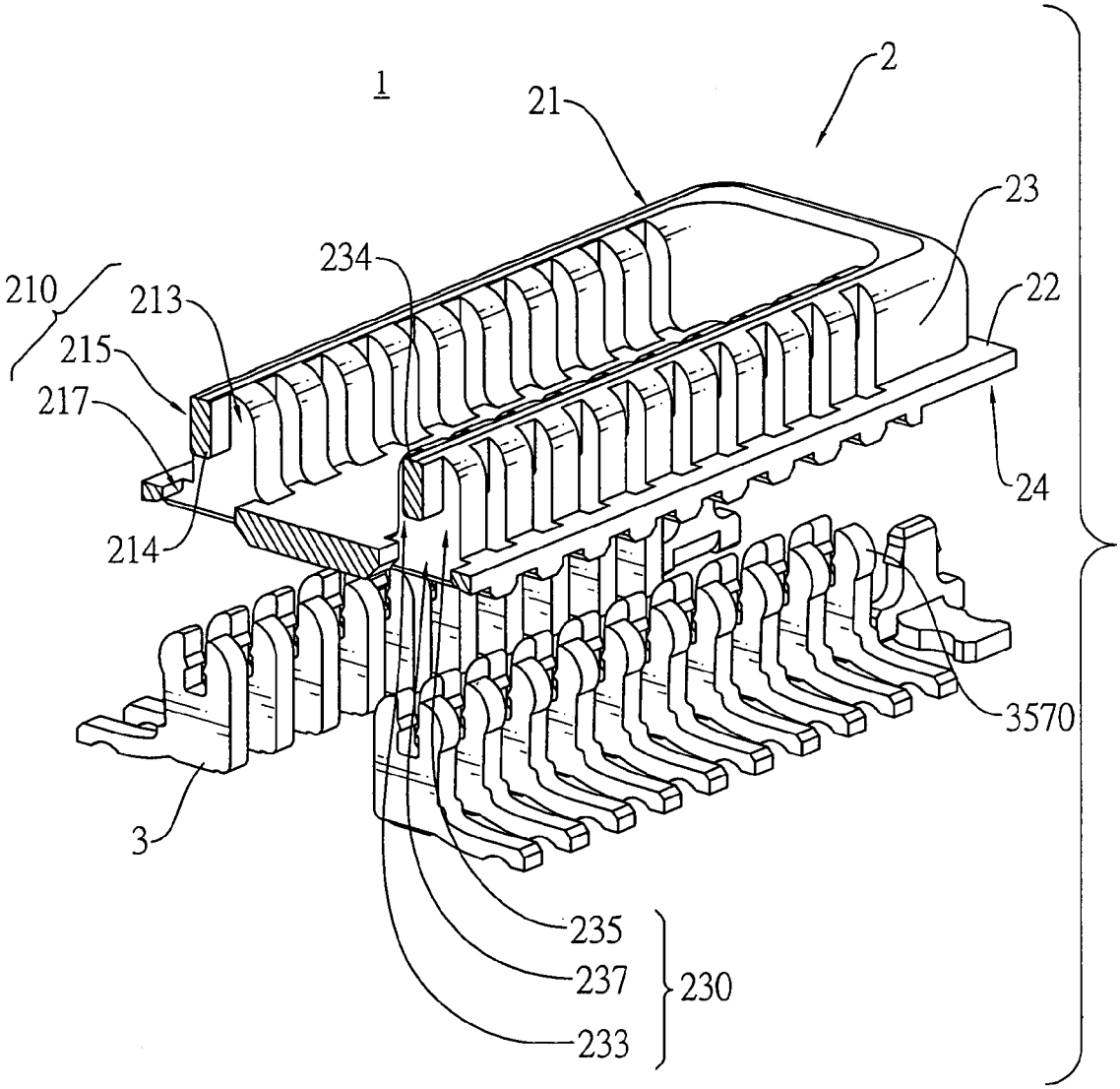
FIG. 7 is an exploded perspective view in partial section of the plug connector in FIG. 5.

With further reference to FIGS. 5 and 7, the plug connector (1) in accordance with the present invention comprises an insulative housing (2) and a plurality of terminals (3).

The terminologies "proximal end", "distal end", "top" and "bottom" herein are relative to the PCBs (P) and "inside" and "outside" are relative to the insulative housing (2).

The insulative housing (2) is symmetrical and longitudinal relative to a Y-axis as shown in FIG. 5, is made of plastic by an insert-molding process, is mounted on a corresponding PCB (P) and has a top (22), a bottom (24), two opposite end walls (25, 27), two opposite sidewalls (21, 23) and a mounting slot (20).

The sidewalls (21, 23) are substantially symmetrical to each other and each sidewall (21, 23) is connected between the end walls (25, 27) and has a plurality of mounting channels (210, 230). The mounting channels (210, 230) are defined through the sidewall (21, 23) from the bottom (24) to the top (22), may be forked or Y-shaped and each mounting channel (210, 230) has an inner surface, an inside passageway (213, 233), an outside passageway (215, 235), an interfering portion (214, 234) and an internal space (217, 237). The inside and outside passageways (213, 233, 215, 235) are defined in the top (22). The interfering portion (214, 234) is parallel to the sidewall (21,23), is formed on the inner surface between the inside and outside passageways (213, 233, 215, 235) to separate the inside and outside passageways (213, 233, 215, 235). The internal space (217, 237) is defined in the bottom (24) and communicates with inside and outside passageways (217, 237). When the mounting channel (1) is forked or Y-shaped, the internal space (217, 237) serves as a root and the inside and outside passageways (213, 233, 215, 235) serve as two branches.

The mounting slot (20) is defined in the top (22) and is surrounded by the sidewalls (21, 23) and the end walls (25, 27).

Figure 8:
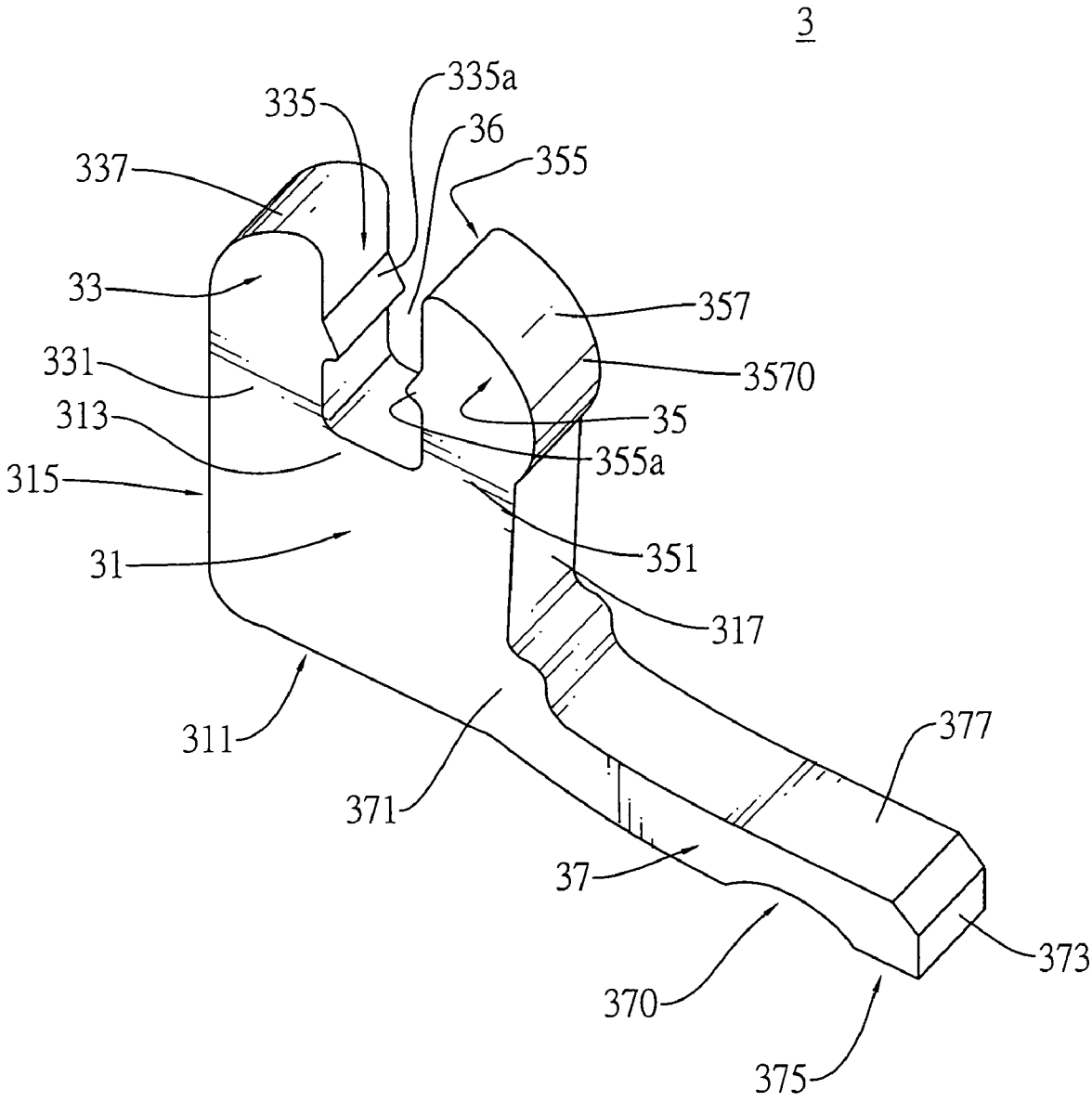
FIG. 8 is a perspective view of the signal terminal of the plug connector in FIG. 7.

With further reference to FIG. 8, the signal terminals (3) are mounted respectively in and correspond respectively to the mounting channels (210, 230). Each signal terminal (3) may be a singular piece made of phosphor bronze and has a body portion (31), a first clamping portion (33), a second clamping portion (35), a clamping recess (36) and a soldering portion (37).

The body portion (31) is mounted in the internal space (217, 237) of a corresponding mounting channel (210, 230) and has a proximal end (311), a distal end (313), an inside (315) and an outside (317).

The first clamping portion (33) is formed integrally on and protrudes longitudinally from the distal end (313) of the body portion (31) adjacent to the inside (315), is mounted in the inside passageway (213, 233) of the corresponding mounting channel (210, 230) and has a connecting end (331), an inside surface (335), a distal end (337) and at least one barb (335*a*). The connecting end (331) is connected securely to the distal end (313) of the body portion (31). The at least one barb (335*a*) is formed on and protrudes from the inside surface (335) and stabs the interfering portion (214, 234) of the corresponding mounting channel (210, 230).

The second clamping portion (35) is formed integrally on and protrudes longitudinally from the distal end (313) of the body portion (31) adjacent to the outside (317), is mounted in the outside passageway (215, 235) of the corresponding mounting channel (210, 230) and has a connecting end (351), an inside surface (355), a distal end (357) and at least one barb (355*a*). The connecting end (351) is connected securely to the distal end (313) of the body portion (31). The distal end (357) may have a convex outside edge (3570). The at least one barb (355*a*) is formed on and protrudes from the inside surface (355) and stabs the interfering portion (214, 234) of the corresponding mounting channel (210, 230).

The clamping recess (36) is defined between the first and second clamping portions (33, 35) and securely and tightly hold the interfering portion (214, 234) of the corresponding mounting channel (210, 230) between the first and second clamping interfering portions (33, 35). Therefore, the signal terminal (3) is securely mounted in the corresponding channel (210, 230).

The soldering portion (37) is formed integrally on and protrudes transversely outwards from the outside (317) of the body portion (31), is soldered on the corresponding PCB (P) and has a connecting end (371), a distal end (373), a bottom edge (375), a top edge (377) and a solder notch (370). The connecting end (371) is connected to the outside (317) of the body portion (31). The solder notch (370) is defined in the bottom edge (375) and may accommodate solder that securely mounts the soldering portion (37) on the PCB (P).

The receptacle connector (6) matches and is engaged detachably with the plug connector (1) and has an insulative housing (7) and a plurality of terminals (8).

The insulative housing (7) has a spine (71) formed centrally on and protruding from the insulative housing (7) and engaged detachably with the mounting slot (20) in the insulative housing (2) of the plug connector (1).

The terminals (8) are mounted in the insulative housing (7) and may electrically contact respectively the signal terminals (3) of the plug connector (1). Each terminal (8) has a U-shaped contacting portion detachably hooking and contacting first and second clamping portions (33, 35) and interfering with the convex outside edge (3570) of a corresponding signal terminal (3) of the plug connector (1) to prevent the signal terminals (3) from inadvertently separating from the terminals (8).

When the plug connector (1) is assembled, the signal terminals (3) are mounted respectively in the mounting channels (210, 230) of the insulative housing (2) by a fixture. The first and second clamping portions (33, 35) of each signal terminal (3) extend respectively into the outside and inside passageways (213, 233, 215, 235) of a corresponding mounting channel (210, 230). The barbs (335*a*, 355*a*) tightly bites the interfering portion (214, 234) in the corresponding channel (210, 230) to securely hold the signal terminal (3) on the insulative housing (2). Then, the insulative housing (2) is cut off to retain a predetermined number of the signal terminals (3) thereon.

The barbs (335*a*, 355*a*) in the signal terminals (3) tightly stab and bite the interfering portions (214, 234) in the corresponding mounting channels (210, 230) to securely hold and prevent the signal terminals (3) from being disassembled out of the insulative housing (2) when the plug connector (1) suffers external forces.

Furthermore, the convex outside edge (3570) of the second clamping portion (35) of each signal terminal (3) of the plug connector (1) interferes with the U-shaped contacting portion of the terminal (8) of the receptacle connector (6) to prevent the plug connector (1) from being detached inadvertently from receptacle connector (6). Therefore, the plug connector (1) is firm and durable and may be applied in portable electronic devices that would easily collide or fall off.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A signal terminal comprising:

a body portion having a proximal end, a distal end, an inside and an outside;

a first clamping portion protruding longitudinally from the distal end of the body portion and having a connecting end connected to the distal end of the body portion;

an inside surface;

a distal end; and at least one barb formed on and protruding from the inside surface, the barb being spaced from the distant end;

a second clamping portion and protruding longitudinally from the distal end of the body portion and having a connecting end connected to the distal end of the body portion;

an inside surface;

a distal end; and at least one barb formed on and protruding from the inside surface of the second clamping portion, the barb being spaced from the distant end;

a clamping recess defined between the first and second clamping portions; and a soldering portion protruding transversely from the outside of the body portion and having a connecting end connected to the outside of the body portion;

a distal end;

a bottom edge; and a top edge.

2. The signal terminal as claimed in claim 1 further comprising a solder notch defined in the bottom edge of the soldering portion.

3. The signal terminal as claimed in claim 2, wherein the first clamping portion is formed integrally on the distal end of the body portion;

the second clamping portion is formed integrally on the distal end of the body portion; and the soldering portion is formed integrally on the outside of the body portion.

4. The signal terminal as claimed in claim 3, wherein the distal end of the second clamping portion has a convex outside edge.

5. The signal terminal as claimed in claim 4, wherein the signal terminal is a singular piece made of phosphor bronze.

6. A plug connector comprising:

an insulative housing having a top, a bottom, two opposite end walls, two opposite sidewalls and each sidewall connected between the end walls and having a plurality of mounting channels defined through the sidewall from the bottom to the top and each mounting channel having an inner surface;

an inside passageway defined in the top;

an outside passageway defined in the top;

an interfering portion formed on the inner surface between the inside and outside passageways; and an internal space defined in the bottom and communicating with inside and outside passageways; and a plurality of signal terminals corresponding respectively to and mounted respectively in the mounting channels and each signal terminal having a body portion mounted in the internal space of a corresponding mounting channel and having a proximal end, a distal end, an inside and an outside;

a first clamping portion protruding longitudinally from the distal end of the body portion, mounted in the inside passageway of the corresponding mounting channel and having a connecting end connected to the distal end of the body portion;

an inside surface;

a distal end; and at least one barb formed on and protruding from the inside surface and stabbing the interfering portion of the corresponding mounting channel;

a second clamping portion and protruding longitudinally from the distal end of the body portion, mounted in the outside passageway of the corresponding mounting channel and having a connecting end connected to the distal end of the body portion;

an inside surface;

a distal end; and at least one barb formed on and protruding from the inside surface of the second clamping portion and stabbing the interfering portion of the corresponding mounting channel;

a clamping recess defined between the first and second clamping portions and holding the interfering portion of the corresponding mounting channel between the first and second clamping portions; and a soldering portion protruding transversely from the outside of the body portion and having a connecting end connected to the outside of the body portion;

a distal end;

a bottom edge; and a top edge.

7. The plug connector as claimed in claim 6, wherein each signal terminal further has a solder notch defined in the bottom edge of the soldering portion.

8. The plug connector as claimed in claim 7, wherein in each signal terminal the first clamping portion is formed integrally on the distal end of the body portion;

the second clamping portion is formed integrally on the distal end of the body portion; and the soldering portion is formed integrally on the outside of the body portion.

9. The plug connector as claimed in claim 8, wherein the distal end of the second clamping portion of each signal terminal has a convex outside edge.

10. The plug connector as claimed in claim 9, wherein each signal terminal is a singular piece made of phosphor bronze.

* * * * *